US008206277B2

(12) United States Patent
Sutton et al.

(10) Patent No.: US 8,206,277 B2
(45) Date of Patent: Jun. 26, 2012

(54) IDLER ROLLER ASSEMBLY HAVING A ROLLER AND A SHAFT THE ROLLER BEING FORMED SUCH THAT IT REMAINS PARALLEL TO CONTACTED MEDIA DESPITE DEFLECTION OF THE SHAFT

(75) Inventors: Donald C. Sutton, Camas, WA (US); Tad A. Unger, Vancouver, WA (US); Kevin B. Hulick, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 668 days.

(21) Appl. No.: 12/258,748

(22) Filed: Oct. 27, 2008

(65) Prior Publication Data

US 2009/0273133 A1 Nov. 5, 2009

Related U.S. Application Data

(60) Provisional application No. 61/049,416, filed on Apr. 30, 2008.

(51) Int. Cl.
*B05C 1/08* (2006.01)
*G03G 15/20* (2006.01)

(52) U.S. Cl. ..... 492/7; 492/6; 492/18; 492/25

(58) Field of Classification Search ..... 492/6, 7, 492/16, 18, 25, 57; 399/400
See application file for complete search history.

(56) References Cited

U.S. PATENT DOCUMENTS 242,058 A * 5/1881 Schurmann ..... 492/6
1,868,860 A * 7/1932 Von Reis ..... 198/780
2,187,250 A * 1/1940 Sendzimir ..... 72/241.4
2,651,103 A * 9/1953 Hornbostel ..... 492/6
2,686,590 A * 8/1954 Sloane ..... 198/824
2,817,940 A * 12/1957 Lorig ..... 226/192
2,948,384 A * 8/1960 Pate ..... 198/825
3,055,083 A * 9/1962 Stobi ..... 492/7
3,097,591 A * 7/1963 Justus ..... 100/155 R
3,161,125 A * 12/1964 Hornbostel ..... 100/155 R
3,522,643 A 8/1970 Winkler
3,678,846 A * 7/1972 Bjorkegren ..... 100/155 R
3,698,540 A * 10/1972 Jordan ..... 198/806
3,750,246 A * 8/1973 Pessen ..... 492/6
3,840,958 A * 10/1974 Mahn ..... 492/6
3,961,737 A * 6/1976 Fatula ..... 226/192
4,053,039 A * 10/1977 Shuttleworth ..... 193/35 R
4,158,128 A * 6/1979 Evdokimov et al. ..... 219/469
4,181,217 A * 1/1980 Huls et al. ..... 198/842
4,196,805 A * 4/1980 Banno ..... 198/827
4,305,191 A * 12/1981 Enomoto ..... 492/7
4,311,509 A * 1/1982 Reader et al. ..... 65/351
4,487,122 A * 12/1984 George et al. ..... 101/153
4,601,775 A * 7/1986 Grone ..... 156/523
4,603,459 A * 8/1986 Buchanan ..... 492/15
4,726,293 A * 2/1988 Ende ..... 101/228
4,768,050 A * 8/1988 Beery ..... 396/583
4,780,746 A * 10/1988 Naramore et al. ..... 271/274
4,823,450 A * 4/1989 Ramisch et al. ..... 492/7
4,856,155 A * 8/1989 Niskanen et al. ..... 492/5

(Continued)

*Primary Examiner* — David Bryant
*Assistant Examiner* — Jason L Vaughan

(57) ABSTRACT

An apparatus and method support rollers with a shaft along an axis absent of deflection of the shaft. Under load, the shaft deflects and the rollers reorient themselves along the shaft such that outer circumferential surfaces of the rollers are substantially parallel to the undeflected axis.

18 Claims, 4 Drawing Sheets

U.S. PATENT DOCUMENTS 5,096,050 A * 3/1992 Hodlewsky ..... 198/779
5,548,897 A * 8/1996 Link ..... 29/895.32
5,913,266 A * 6/1999 Nakaya et al. ..... 101/375
6,032,778 A * 3/2000 O'Donnell ..... 193/37
6,068,582 A * 5/2000 Grabscheid ..... 492/16
6,154,626 A * 11/2000 Litman et al. ..... 399/282
6,360,865 B1 * 3/2002 Leon ..... 193/35 MD
6,468,193 B1 * 10/2002 Shimoda ..... 492/45
6,685,076 B2 * 2/2004 Couillard ..... 226/186
6,935,486 B2 * 8/2005 Davis ..... 198/781.02
7,255,041 B2 * 8/2007 Riedel ..... 101/153
7,570,914 B2 * 8/2009 Kim et al. ..... 399/388
7,789,818 B2 * 9/2010 Gruber-Nadlinger et al. .... 492/9
2006/0183613 A1 * 8/2006 Niemeyer ..... 492/7
2008/0044206 A1 * 2/2008 Kotaka et al. ..... 399/308

* cited by examiner

IDLER ROLLER ASSEMBLY HAVING A ROLLER AND A SHAFT THE ROLLER BEING FORMED SUCH THAT IT REMAINS PARALLEL TO CONTACTED MEDIA DESPITE DEFLECTION OF THE SHAFT

CROSS REFERENCE TO RELATED APPLICATIONS

This Application claims the benefit of provisional patent application Ser. No. 61/049,416, filed Apr. 30, 2008 titled "ROLLER" which application is incorporated by reference herein as if reproduced in full below.

BACKGROUND

Opposing rollers are used to transport media. The opposing rollers may damage the media due to high contact forces.

DETAILED DESCRIPTION OF THE EXAMPLE EMBODIMENTS

Figure 1:
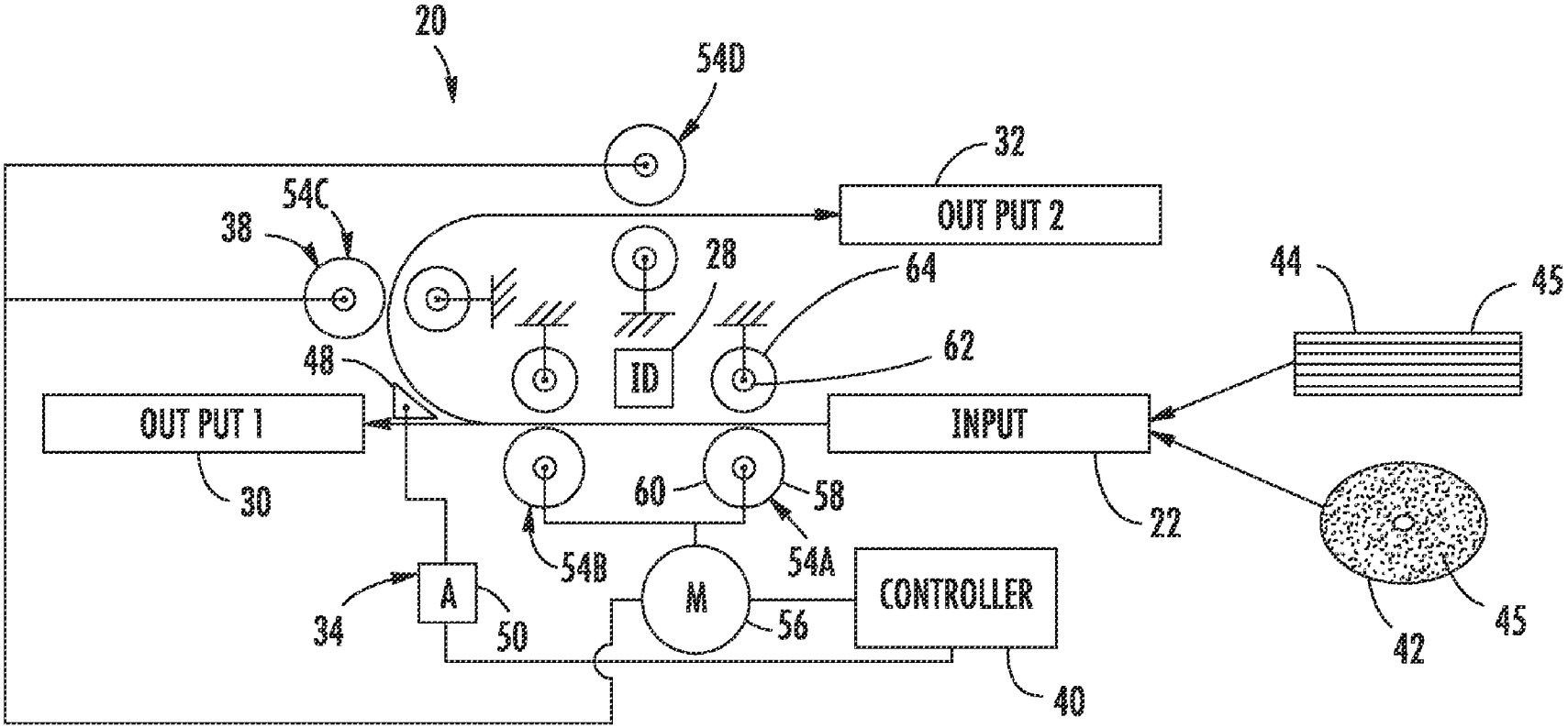
FIG. 1 is a schematic illustration of a media interaction device according to an example embodiment.

FIG. 1 schematically illustrates media interaction system 20 according to an example embodiment. Media interaction system 20 is configured to transport media from one or more inputs to one or more outputs and to interact with the media in one or more fashions. As will be described in more detail hereafter, system 20 transports or moves the media using roller drives which may reduce damage to the media during such transport.

Media interaction system 20 includes input 22, interaction device 28, outputs 30, 32, diverter system 34, media transport system 38 and the controller 40. Input 22 comprises one or more structures configured to store and supply media to be interacted upon by system 20. Input 22 may comprise a tray, bin or other structure. Although input 22 is illustrated as having a generally horizontal orientation, input 22 may alternatively be vertical or inclined. In the particular embodiment illustrated, input 22 is configured to store and supply different types of media such as disk media 42 and photo media 44.

Disk media 42 comprises substantially rigid disks of media configured to be printed upon such that disc 42 may be provided with visually or optically perceptible labels or images. Photo media 44 comprises media having one or more surface treatments, architectures or chemistries that facilitate the absorption and retention of fluids or inks, resulting in the printing of images or photos having resolutions comparable to film developed photographs.

Both disk media 42 and photo media 44 may have surfaces 45 that are porous. The porous nature of such surfaces 45 enhances their ability to absorb and retain fluids or inks. However, the same time, the porous nature of such surfaces 45 may render such surfaces 45 more susceptible to damage due to excessive pressure during their transport before or after printing. This crushing may cause visible defects in some types of media.

Interaction device 28 comprises a device configured to interact with media supply from input 22 and transported by transport system 38. In the particular example illustrated, interaction device 28 comprises a device configured to print optically visible images, data, labels or the like onto one or more surfaces of media supplied by input 22. For example, in one embodiment, interaction device 28 may comprise one or more drop-on-demand inkjet print heads configured to selectively eject fluid, such as one or more colors of ink, onto a surface of media, such as media 42 or media 44. In other embodiments, interaction device 28 may comprise an electrophotographic or electrostatic printing device in which dry or liquid toner is applied to one or more surfaces of a medium. In still other embodiments, interaction device 28 may comprise other devices that interact with media in other fashions.

Outputs 30 and 32 comprise one or more structures configured to receive media that has been interacted upon by interaction device 28. In one embodiment, outputs 30, 32 may be configured to store and provide a person with access to interacted upon media. In other embodiments, outputs 30, 32 may alternatively be configured to further provide the interacted upon media to other media interaction systems or other media handling devices.

In the example illustrated, output 30 comprise a tray, bin or other storage structure located substantially directly across from input 22 for providing a straight or linear media path from input 22 to output 30 and across interaction device 28. Output 30 is located such that relatively rigid media, generally incapable of being bent during its transport, may be moved from input 22 to output 30. In the example illustrated, output 30 is configured to receive disk media 42. In other embodiments, output 30 may be configured to also receive other substantially inflexible media after the inflexible media has been interacted upon. In other embodiments, output 30 may also receive flexible media.

Output 32 comprises a tray, bin or other storage structure proximate to input 22 generally on the same side of interaction device 28 as input 22. Output 32 provides a person with access to interacted upon media on the same side of system 20 as input 22. Input 32 receives such media after such media has been interacted upon and after such media has traveled a generally arcuate path around interaction device 28. In the example illustrated, output 32 is configured to receive and store substantially bendable or flexible media, such as photo media 44. Although output 32 is illustrated as being located above input 22, in other embodiments, output 32 may be located below input 22.

Diverter system 34 comprises a mechanism configured to selectively channel, guide or direct media that has been interacted upon by interaction device 28 to either output 30 or output 32. Diverter system 34 includes diverter 48 and actuator 50. Diverter 48 comprises a movable member configured to selectively engage media being moved by media transport system 38. In the example illustrated, diverter 48 comprises a finger which pivots between a first position in which media is directed to output 30 and a second position in which media alternatively directed to output 32.

Actuator 50 comprises a mechanism configured to pivot diverter 48 between the first position and the second position. In one embodiment, actuator 50 may comprise a hydraulic or pneumatic cylinder-piston assembly or an electric solenoid. In another embodiment, actuator 50 may comprise a cam arrangement which derives power from the motor used to drive media transport 38, wherein the power is used to selectively move or pivot diverter 48 between the first position and the second position. In other embodiments where output 30 or output 32 is omitted, diverter system 34 may also be omitted.

Media transport system 38 comprises a mechanism configured to transport media, such as media 42 or media 44, from input 22 to interaction device 28 and further to either output 30 or output 32. Media transport system 38 includes roller drives 54A, 54B, 54C and 54D (collectively referred to as roller drives 54) and motor 56. In the example illustrated, roller drives 54A and 54B are located on opposite sides of interaction device 28 with roller drive 54A closest to input 22. Roller drive 54A moves media from input 22 across interaction device 28 to roller drive 54B. Roller drive 54B further transports media either to output 30 or to roller drive 54C. Roller drive 54C transports the media further around interaction device 28 to roller drive 54D. Roller drive 54D transports the media to output 32. In other embodiments, media transport system 38 may include a greater or fewer of such roller drives. Media transport system 38 may include roller drives at alternative locations as well.

Each of roller drives 54 includes a driven shaft 58, one or more drive rollers 60, a support shaft 62 and one or more idling rollers 64. Driven shaft 58 is operably coupled to motor 56 so as to be rotationally driven. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Drive rollers 60 are coupled to shaft 58 such that rotation of rollers 58 results in rotation of roller 60. Drive rollers 60 may alternatively be an integral part of driveshaft 58. Rollers 60 are configured to contact a face of media, such as media 42 or media 44, so as to drive and urge media along an associated media path.

Idling rollers 64 are supported by idler support shafts 62. In the example illustrated, idling rollers 64 are located substantially opposite to drive rollers 60 such a form a nip there between. Rollers 60 cooperate with rollers 64 to pinch media in a nip such that roller 60 frictionally engaged the media to drive the media. Idling rollers 64 substantially freely rotate with respect to and about shafts 62 but for friction between rollers 64 and shafts 62. Shafts 62 are substantially fixed against rotation. In another embodiment, shafts 62 may also be configured to rotate along with rollers 64. In the example embodiment illustrated, neither shafts 62 nor rollers 64 are rotationally driven so as to drive media. Any rotation of rollers 64 is a result of force being applied to roller 62 by media which is being driven by rollers 60. As will be described hereafter, rollers 64 are configured such that they maintain substantial parallelism with the media being driven by rollers 60 even during deflection of shafts 62. As a result, a more uniform force is applied to a face of the media by rollers 64, reducing maximum pressure and thereby reducing damage to the media and to any wet or dry image printed upon the media.

Figure 2B:
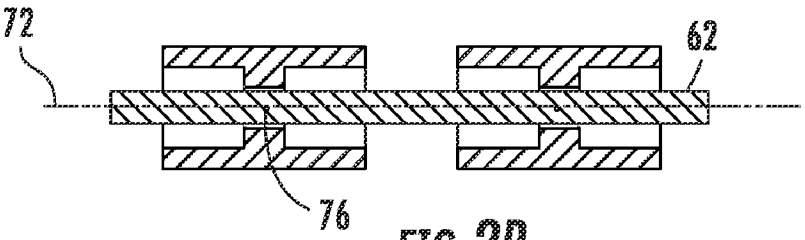
FIG. 2B is a sectional view of the shaft and idling rollers during deflection of the shaft and taken along line 2B-2B of FIG. 2A according to an example embodiment.
Figure 3B:
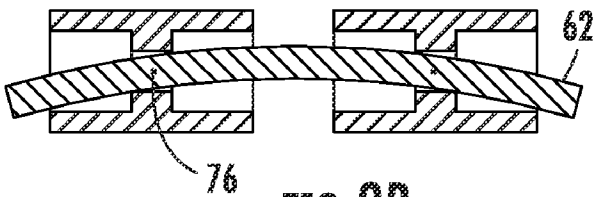
FIG. 3B is a sectional view of the shaft and idling rollers during deflection of the shaft and taken along line 3B-3B of FIG. 3A according to an example embodiment.
Figure 2A:
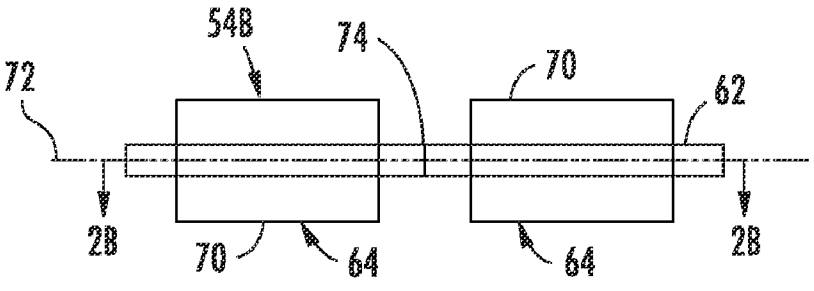
FIG. 2A is a top plan view of a shaft absent of deflection of idling rollers of the media interaction device of FIG. 1 according to an example embodiment.
Figure 3A:
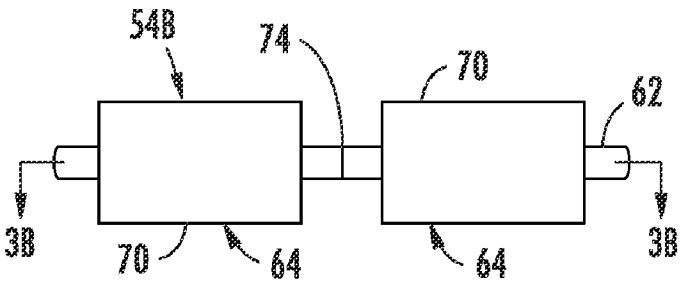
FIG. 3A is a top plan view of a shaft during deflection of idling rollers of the media interaction device of FIG. 1 according to an example embodiment.
Figure 4:
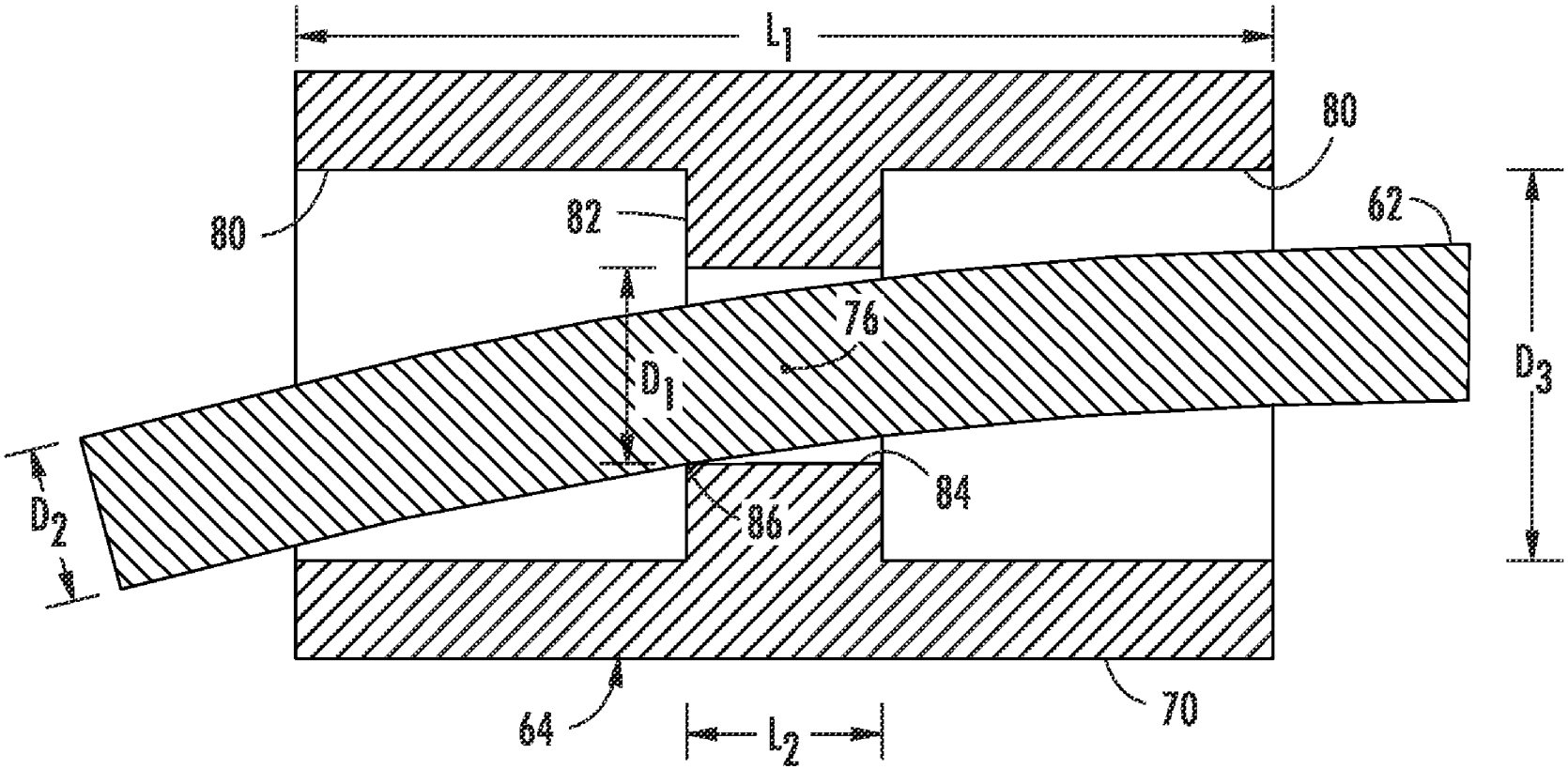
FIG. 4 is an enlarged sectional view of a left side of the shaft and idling rollers of FIG. 3 according to an example embodiment.

FIGS. 2-4 illustrate support shaft 62 with rollers 64 in detail. The remaining shafts 62 and rollers 64 and the other remaining roller drives 54A, 54C and 54D are substantially similar to those of roller drive 54B. FIGS. 2A and 2B illustrate roller shaft 62 and rollers 64 of roller drive 54B absent deflection of shafts 62. FIG. 2A is a top plan view and FIG. 2B is a sectional view. As shown by FIGS. 2A and 2B, absent deflection in shaft 62, rollers 64 have outer circumferential surfaces 70 which extended substantially parallel to axis shaft 62. The outer circumferential surfaces 70 of rollers 64 are in substantial alignment with one another about axes 72. As further shown by FIG. 2A, rollers 64 are symmetrically supported upon shaft 62 and are equidistantly spaced from a center point 74 of shaft 62. Although roller drive 58B is illustrated as having two such rollers 64, in other embodiments, roller drive 58B may have greater or fewer of such rollers 64. For example, in another embodiment, roller drive 54 may alternatively have four of either rollers 64. In other embodiments, multiple instances of shaft 62 may be provided along a common axis, either maintained in alignment or independent of each other, to increase a total width of media contact with the rollers.

FIG. 3B illustrates roller shaft 62 and rollers 64 of roller drive 54B during deflection of shafts 62. FIGS. 3B and 4 are sectional views of roller drive 54B during deflection of shaft 62. FIG. 3B is a sectional view of roller drive 54B taken along line 3B-3B of FIG. 2. FIG. 4 is an enlarged fragmentary sectional view of the left half of roller drive 54B. As shown by FIG. 3B, as a result of contact with media being pinched between rollers 60 and opposing rollers 64, shaft 62 may bend or deflect under load.

If rollers 64 were supported by shafts 62 in a manner such that roller 64 remains parallel to the portion of shaft 62 supporting a particular roller 64, the outer circumferential surfaces 70 of such rollers would no longer be parallel to the media between rollers 60 and 64. As a result, portions of the outer circumferential surface 70 of each of rollers 64 would exert a greater force against the media. Such non-uniform application of force by outer circumferential surfaces 70 across the axial length of rollers 64 might otherwise damage the porous media or damage the printed image upon the media. For example, such non-uniform application of force by rollers 64 might cause streaking or other undesirable marks upon the media. In one embodiment, the resulting non-uniform and locally excessive pressure restricts absorption of ink, causing visibly lighter bands on some types of print bull rigid media.

However, as shown by FIG. 3, each of rollers 64 is configured so as to reorient itself while being rotationally supported by shafts 62. In particular, each of rollers 64 is configured to rotate or pivot relative to shaft 62 about an axis 76 extending perpendicular to axis 72, permitting outer circumferential surfaces 70 to maintain their substantial parallelism with the media contacting outer circumferential surfaces 70. As a result, rollers 64 more uniformly applies pressure or force to the media being contacted to avoid excessive force concentrations at the end of rollers 64, reducing damage that might otherwise occur to the medium or to the image printed upon the medium.

As shown by FIG. 4, each of rollers 64 has an axial length L1 and includes internal oppositely extending counterbores 80 extending from opposite axial ends of roller 64 and terminating at a central hub 82. Central hub 82 includes a bore 84 configured to receive shaft 62. Bore 84 has an internal diameter D1 sufficiently larger than the outer diameter D2 of shaft 62 to permit roller 64 to reorient itself about axis 76 to substantially maintain outer circumferential surface 70 of roller 64 substantially parallel with the media being contacted by roller 64 despite the deflection of shaft 62. In other words, central hub 82 serves as a central ring which functions as a swivel. At the same time, counterbores 80 each have an internal diameter D3 sufficiently large to provide clearance for shaft 62 such that shaft 62 only contacts hub 82 of roller 64 during deflection of shaft 62 such that load is distributed from central hub 82. In other words, the inner circumferential surfaces of counterbores 80 remain spaced from shaft 62 during maximum deflection of shaft 62. Diameter D3 is sufficiently large to further accommodate wear of hub 82 over time.

In the example embodiment illustrated, hub 82 has a sufficiently short axial length L2 such that roller 64 may sufficiently reorient itself, depending upon the extent to which shaft 62 deflects, to maintain the parallelism of outer circumferential surface 70 with the media being contacted. During such deflection, roller 64 merely contacts shaft 62 at the lower contact points 86 located proximate to a lower axial end of bore 84. Consequently, force is transmitted between rollers 64 and shaft 62 only at contact shaft 62 at point 86.

Roller 64 has an axial length L1 such that the loads are substantially symmetrically distributed and to some extent evenly distributed axially along roller 64. In the example illustrated, hub 82 has an axial length L2 of less than or equal to about 0.2 L1. In other embodiments, where the expected extent of deflection of shaft 62 is greater, hub 82 may have a shorter axial length. In addition, diameters D1 and D3 may be larger. Although roller 64 is illustrated as accommodating upward inflection of central point 74 of shaft 62 during engagement with media, roller 64 just as well accommodates other non-axial directions of deflection, such as downward or sideways deflection of central point 74 of shaft 62.

In the example illustrated, roller 64 is integrally formed as a single unitary body, allowing greater control over dimensional variations or tolerances and reducing fabrication cost. In the example illustrated, roller 64 is integrally formed from one polymeric material. As a result, roller 64 is lighter in weight and possesses a self-lubricating, low-friction property, both of which facilitate automatic and relatively fast responsive reorientation of roller 64 about axis 76 during deflection of shaft 62 with a reduced likelihood of sticking Fabrication may also be by injection molding or other high-volume process, resulting in a very inexpensive part. In other embodiments, roller 64 may be formed from distinct components which are bonded, welded, fastened or otherwise secured to one another. Roller 64 may also be formed from other materials, such as metals, in cases which require higher forces, where characteristics, or other factors. Although counterbores 80 and central bores 84 are illustrated as being cylindrical in shape, in other embodiments, counterbores 80 and central bores 84 may have other shapes.

Figure 5:
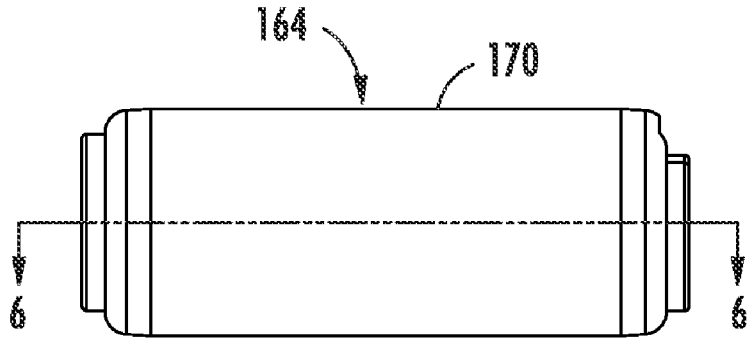
FIG. 5 is a side elevational view of another embodiment of the idling roller of FIG. 2 according to an example embodiment.
Figure 6:
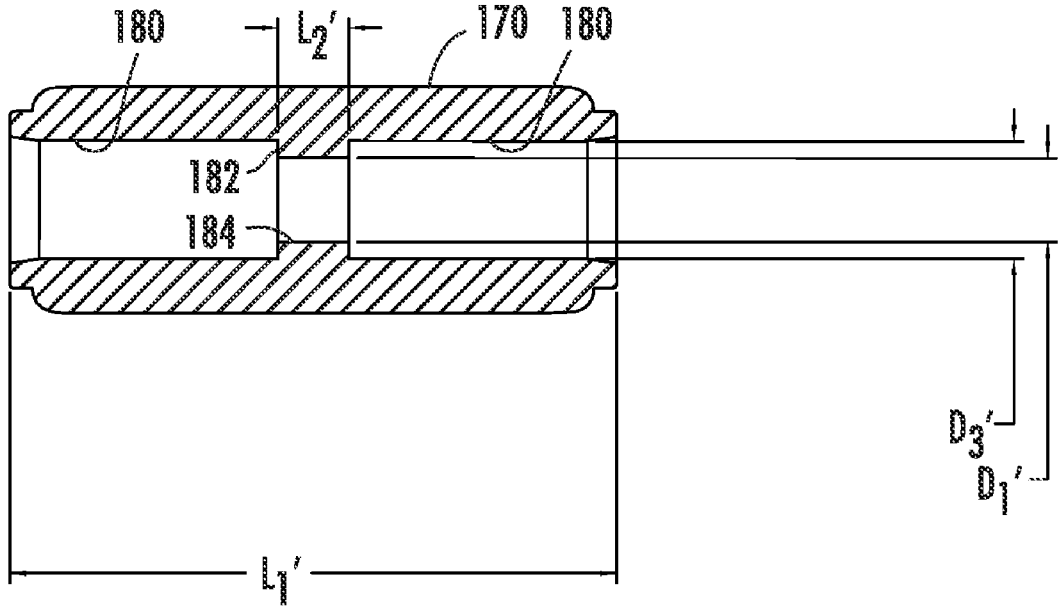
FIG. 6 is a sectional view of the idling roller of FIG. 5 taken along line 6-6 according to an example embodiment.

FIGS. 5 and 6 illustrate roller 164, another embodiment of roller 64. In one embodiment, roller 164 is utilized with media interaction system 20 in place of roller 64 in one or more of roller drives 54. Like roller 64, roller 164 is paired with another roller 164 along a support shaft 62 in a fashion similar to shown in FIGS. 2 and 3. As with roller 64, roller 164 is configured such that it maintains substantial parallelism with the media being driven by rollers 60 even during deflection of shafts 62 (shown in FIGS. 1-3). As a result, a more uniform force is applied to a face of the media by rollers 164, reducing damage to the media and to any wet or dry image printed upon the media.

As shown by FIG. 6, a cross-sectional view of roller 164 shown in FIG. 5, roller 164 has an outer circumferential surface 170 and opposing counterbores 180 which extend from opposite axial ends of roller 164 and terminate at a central hub 182. Central hub 182 is equidistantly located from opposite axial ends of roller 164. Central hub 182 includes an inner bore 184. As with surface 70, surface 170 is configured to contact media opposite to a driven roller coaster form a nip therebetween. As with counterbores 80, counterbores 180 each has an inner diameters D3' sufficiently large such that shaft 62 only contacts hub 182 of roller 164 during deflection of shaft 62. In other words, the inner circumferential surfaces of counterbores 180 remain spaced from shaft 62 during maximum deflection of shaft 62. Diameter D3' is sufficiently large to further accommodate wear of hub 182 over time.

As with hub 82, hub 182 has an internal diameter D1' sufficiently larger than the outer diameter D2 of shaft 62 (shown in FIG. 4) to permit roller 164 to reorient itself about axis 76 to substantially maintain outer circumferential surface 170 of roller 164 substantially parallel with the media being contacted by rollers 164 despite the deflection of shaft 62 (shown in FIG. 3). Hub 182 also has a sufficiently short axial length L2' such that roller 164 may sufficiently reorient itself, depending upon the extent to which shaft 62 deflects, to maintain the parallelism of outer circumferential surface 170 with the media being contacted. At the same time, roller 164 has an axial length L1' such that the loads are substantially symmetrically distributed axially along roller 164. In the example illustrated, hub 182 has an axial length L2' of less than or equal to about 0.2 L1'. In other embodiments, where the expected extent of deflection of shaft 62 is greater, hub 182 may have a shorter axial length. In addition, diameters D1 and D3 may be larger.

According to one example embodiment, roller 164 is integrally formed as a single unitary body out of a polymeric material such as POM. Axial length L1' is 12.07 mm. Axial length L2' is 1.57 mm. Diameter D1' is 1.85 mm. Diameter D3' is 2.6 mm. Shaft 62 (shown in FIGS. 1-3) is formed from Stainless Steel and has a diameter D2 of 1.75 mm. In other embodiments, shaft 62 and roller 164 may be formed from other materials and may have other dimensions, wherein such materials and dimensions still permit roller 164 to reorient itself with respect to shaft 62 so as to maintain substantial parallelism of outer circumferential surface 170 during deflection of shaft 62.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible.

For example, unless specifically otherwise noted, the claims reciting a single particular element also encompass a plurality of such particular elements.

What is claimed is:

1. An idler roller assembly comprising:

a shaft;

a first roller rotationally supported by the shaft;

the first roller having axial length L1 and comprising first counterbores extending from opposite axial ends, the first counterbores forming a first central hub, the first central hub having a first bore configured to receive the shaft, the first central hub having a first length less than or equal to 0.2L1, the first bore having a diameter sufficiently greater than a diameter of the shaft such that the first central hub serves as a swivel, permitting reorientation of the first roller to maintain an outer circumferential surface of the first roller parallel to media being contacted by the first roller despite deflection of the shaft.

2. The idler roller assembly of claim 1, wherein the first roller is integrally formed as a single unitary body.

3. The idler roller assembly of claim 2, wherein the first roller is formed from one or more polymeric materials.

4. The idler roller assembly of claim 1, wherein the first central hub has an axial length configured such that loads are symmetrically distributed axially along the first roller.

5. The idler roller assembly of claim 1 further comprising:

a second roller having an axial length L2 and comprising second counterbores extending from opposite axial ends, the second counterbores forming a second central hub, the second central hub having a second bore configured to receive the shaft, the second central hub having a second length less than or equal to 0.2L2; and the shaft extending through the first central hub and the second central hub.

6. The idler roller assembly of claim 1 further comprising the shaft, wherein the shaft extends along an axis absent of deflection the shaft and wherein the first roller has an outer circumferential surface extending parallel to the axis during deflection of the shaft.

7. The idler roller assembly of claim 5, wherein the second bore has a diameter sufficiently greater than the diameter of the shaft such that the second central hub serves as a swivel, permitting reorientation of the second roller to maintain an outer circumferential surface of the second roller parallel to media being contacted by the second roller despite deflection of the shaft.

8. The idler roller assembly of claim 5, wherein the second central hub as an axial length configured such that loads are symmetrically distributed axially along the second roller.

9. The idler roller assembly of claim 5, wherein the second roller is integrally formed as a single unitary body.

10. The idler roller assembly of claim 7, wherein the second roller is formed from one or more polymeric materials.

11. The idler roller assembly of claim 5 further comprising a print device, wherein the first roller and the second roller are configured to engage a sheet as a sheet is moving towards the print device.

12. The idler roller assembly of claim 1 further comprising: the shaft; and a print device, wherein the roller is configured to engage media as the media is moving towards the print device.

13. An idler roller assembly comprising:

a shaft extending along an axis absent of deflection of the shaft;

a first roller having a first outer circumferential surface and rotationally supported by the shaft such that the first outer circumferential surface extends parallel to the axis during deflection of the shaft;

a second roller having a second outer circumferential surface and rotationally supported by the shaft such that the second outer circumferential surface extends parallel to the axis during deflection of the shaft;

wherein the first roller has first counterbores extending from opposite axial ends, the first counterbores forming a first central hub, the first central hub having a first bore configured to receive the shaft;

wherein the first roller has an axial length L1;

wherein the first central hub as a first axial length of less than or equal to 0.2L1;

wherein the first bore having a diameter sufficiently greater than a diameter of the shaft such that the first central hub serves as a swivel, permitting reorientation of the first roller to maintain an outer circumferential surface of the first roller parallel to media being contacted by the first roller despite deflection of the shaft; and wherein the second roller has second counterbores extending from opposite axial ends the second counterbores forming a second central hub, the second central hub having a second bore configured to receive the shaft;

wherein the second roller has as an axial length;

wherein the second central hub as a second axial length of less than or equal to 0.2L2;

wherein the second bore having a diameter sufficiently greater than a diameter of the shaft such that the second central hub serves as a swivel, permitting reorientation of the second roller to maintain an outer circumferential surface of the second roller parallel to media being contacted by the second roller despite deflection of the shaft.

14. The idler roller assembly of claim 13, wherein the first roller and the second roller are each integrally formed as a single unitary body.

15. The idler roller assembly of claim 14, wherein the first roller and the second roller are each formed from one or more polymeric materials.

16. The idler roller assembly of claim 13, wherein the first axial length of the first central hub is configured such that loads are symmetrically distributed axially along the first roller; and wherein the second axial length of the second central hub is configured such that loads are symmetrically distributed axially along the second roller.

17. The idler roller assembly of claim 13, wherein the first counterbores and the second counterbores have an axial length configured such that inner circumferential surfaces of the first counterbores and the second counterbores are spaced from the shaft during a maximum deflection of the shaft.

18. The idler roller assembly of claim 13 further comprising a print device, wherein the first roller and the second roller are configured to engage a sheet as a sheet is moving towards the print device.

* * * * *

UNITED STATES PATENT AND TRADEMARK OFFICE

CERTIFICATE OF CORRECTION

PATENT NO. : 8,206,277 B2
APPLICATION NO. : 12/258748
DATED : June 26, 2012
INVENTOR(S) : Donald C. Sutton et al.

It is certified that error appears in the above-identified patent and that said Letters Patent is hereby corrected as shown below:

In column 7, line 56, in Claim 10, delete "claim 7," and insert -- claim 9, --, therefor.

In column 8, line 31, in Claim 13, delete "length;" and insert -- length L2; --, therefor.

Signed and Sealed this
Eighth Day of January, 2013

David J. Kappos

David J. Kappos
*Director of the United States Patent and Trademark Office*